US005080237A

United States Patent [19]

Hefner

[11] Patent Number: 5,080,237

[45] Date of Patent: Jan. 14, 1992

[54] HOLDER FOR WASHING AND DRYING BAGS

[76] Inventor: James P. Hefner, 1230 S. Barranca Ave., #E, Glendora, Calif. 91740

[21] Appl. No.: 681,942

[22] Filed: Apr. 8, 1991

[51] Int. Cl.[5] ..... A47F 7/00

[52] U.S. Cl. ..... 211/13; 248/99; 248/95; 248/311.3; 211/189

[58] Field of Search ..... 211/13, 189, 200; 248/311.3, 95, 99; 134/135

[56] References Cited

U.S. PATENT DOCUMENTS

| | | | |
|---|---|---|---|
| 209,749 | 11/1878 | Brown | 248/99 X |
| 241,765 | 5/1881 | Wever | 248/95 X |
| 956,835 | 5/1910 | Taulman | 248/95 |
| 1,835,726 | 12/1931 | Thompson | 248/311.3 X |
| 2,908,463 | 10/1959 | Chenette | 248/95 |
| 3,295,694 | 1/1967 | Nejezchleb et al. | 211/126 |
| 3,826,455 | 7/1974 | O'Donnell | 248/99 X |
| 5,002,246 | 3/1991 | Chaffin et al. | 248/311.3 X |

*Primary Examiner*—Reinaldo P. Machado
*Assistant Examiner*—Sarah A. Lechok

[57] ABSTRACT

An apparatus is provided for holding at least one bag in an inverted position to allow the bag to be sprayed with water for cleaning and then air dried. A support base, resting on a flat surface, has a top face with a plurality of engagement slots therein. At least one frame is included, each frame having two arms, each arm being segmented into two portions pivotally joined at their ends. The support base has two clips to hold at least one frame for compact storage and portability. The ends of each arm are adapted for engagement into said engagement slots. One portion of each arm is pivotally joined to the like portion of the other arm to allow the joined portions to move in scissor-like motion. The distal ends of each arm are adjusted so that the distance between the distal ends is approximately equal to the inside dimension of the bag, the bag being placed in an inverted position over the arms. Each portion of the arms around the points of pivotal joining have a roughened surface to permit two portions to frictionally engage each other and allow the arms to maintain a set position against minor forces. Each portion of the arms has an upset surface to permit two portions to engage each other to facilitate the setting of a preferred set position.

6 Claims, 1 Drawing Sheet

HOLDER FOR WASHING AND DRYING BAGS

FIELD OF THE INVENTION

This invention relates to holders for bags. More particularly, this invention relates to an adjustable holder for washing and drying bags of various sizes.

BACKGROUND OF THE INVENTION

Plastic bags, such as kitchen freezer bags and sandwich bags, have become widely popular due to the convenience they provide and the recent improvements in the design of such bags. However, it has become known that widespread disposal of such bags in landfills causes harm to the environment, due in part to the extended length of time required for the bags to adequately decompose. For this reason, as well as for economic reasons, many people have been washing such bags after use, drying them, and then reusing them instead of disposing of them.

As described in U.S. Pat. No. 3,295,694, issued to Nejezchleb and Nejezchleb on Jan. 3, 1967, a plastic bag will not, if left by itself, adequately dry due to a lack of ventilation caused by the sides of the bag remaining in contact. As a result, several devices have been invented to facilitate the drying of such bags. For example, one such device utilizes a tray with multiple U-shaped bag-supporting members, over which are inverted wet plastic bags. This device holds the sides of the bag apart, allowing air to ventilate the bag and subsequently dry it. However, this device requires more than one U-shaped bag-supporting member if the bag is significantly larger than a single such bag-supporting member. Moreover, if the bag happens to be smaller than the bag-supporting member, this device cannot be used without tearing the bag or modifying the shape of the bag-supporting member, potentially breaking it. Further, this device includes a relatively large support tray, which makes it inconvenient for use on many relatively small kitchen counters, window sills, and the like. Still further, this device is rather difficult to transport since, when disassembling the bag-supporting members from the tray to reduce the size of the device, there is no convenient place to store the bag-supporting members.

Clearly, then, there is a need for a bag holding device that is adaptable to many sizes of bags, that is relatively compact, that is capable of holding more than one bag, and that is easily disassembled and transported. The present invention fulfills these needs and provides further related advantages.

SUMMARY OF THE INVENTION

The present invention is a holder for washing and drying bags. A support base has a bottom face for resting upon a flat support surface, and a top face with a plurality of engagement groves formed therein. At least one frame is included, the frame having two arms, each arm being segmented into two portions pivotally joined at the ends thereof.

In operation, one end of each arm is inserted into one engagement grove, thereby supporting the arm in a generally vertical orientation. The other arm is positioned in an upward orientation and adjusted to form an angle between the two arms, the distal ends of the arms being adjusted so that the distance between them is approximately equal to the inside dimension of a bag. The bag is then inverted over the arms and consequently held in an open state to allow the bag to by sprayed with water for cleaning and then air dried.

Each of the two portions of each arm has a roughened surface around the point of pivotal joining to permit the two portions to frictionally engage each other to allow the arms to maintain a set position against minor forces, such as the weight of the bag. Moreover, each of the two portions of each arm has an upset surface to permit the two portions to engage each other at predetermined angles to facilitate the setting of a preferred set position. Still further, the support base has two clips for holding at least one arm to facilitate transportation of the invention and for compact storage.

This invention provides a compact holder for washing and drying bags, is adaptable to a wide variety of bag sizes easily, can hold more than one bag, and is easily transported and stored. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
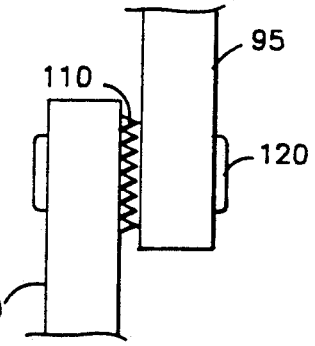
FIG. 2 is a fragmentary side illustration of a pivot region of an arm of the invention.
Figure 1:
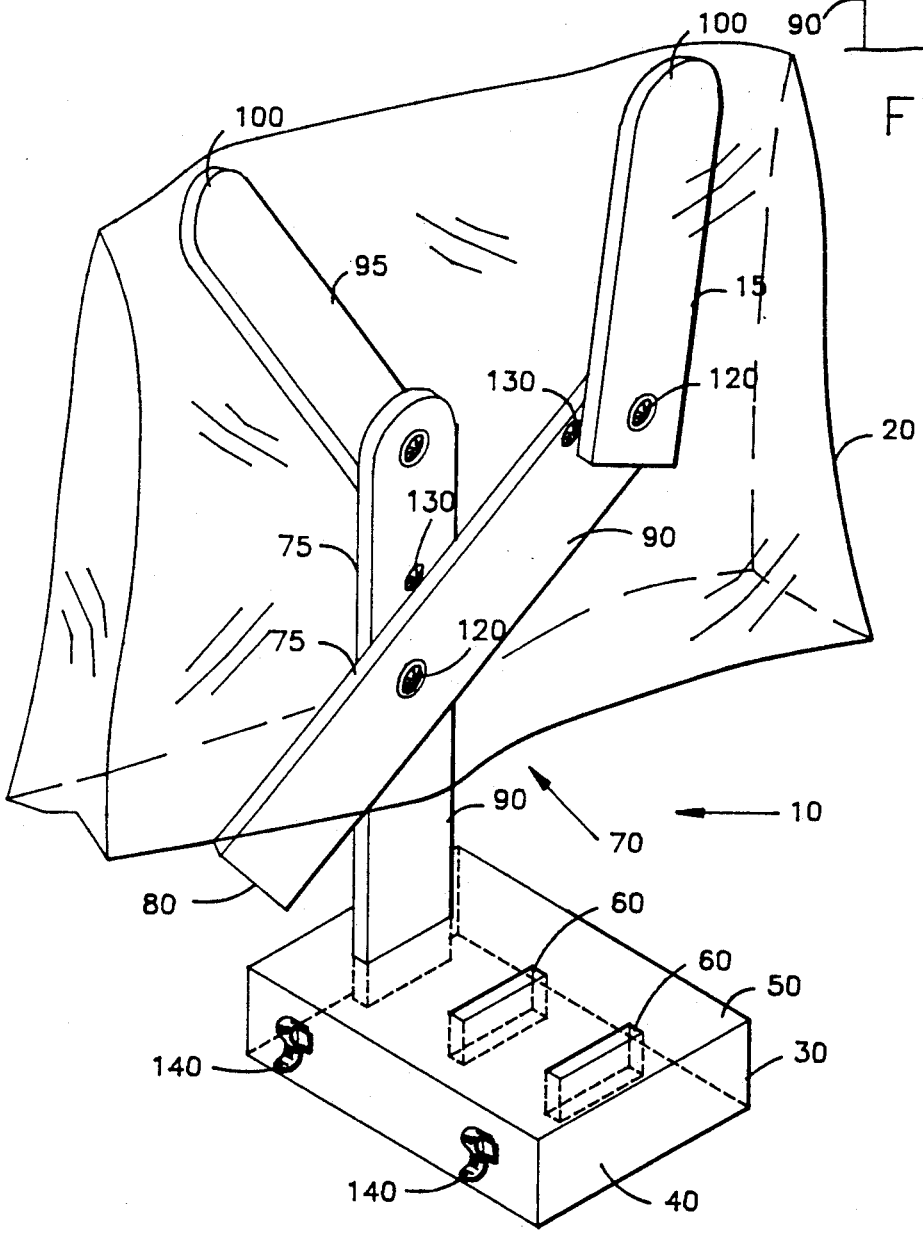
FIG. 1 is a perspective illustration of the invention, illustrating a bag as held in normal use of the invention.

FIGS. 1 and 2 show a holder 10 for washing and drying at least one bag 20. A support base 30 has a bottom face 40 for resting upon a flat support surface (not shown). A top face 50 has at least one engagement means 60 formed therein. The support base 30 is made from a rigid material, such as plastic, that can easily be manufactured in a variety of suitable colors.

At least one frame 70 is included, each frame 70 having two arms 75, each arm 75 being segmented into two portions 90 and 95. Each portion 90 is pivotally joined at a pivot point 120 to the other portion 90 of the other arm 75 to allow the joined portions 90 to move in scissor-like motion, enabling the frame 70 to be adjusted to a variety of sizes of bags 20. Ends 80 of each of the arms 75 are adapted for engagement in the engagement means 60. Preferably, each frame 70 is manufactured from a rigid plastic material. Also in the preferred mode of the invention, each portion 90 and 95 have roughened surfaces 110 about the pivot points 120 in order to permit frictional engagement of the portions 90 and 95, thereby maintaining a desired angular position against minor forces; such forces might include the weight of the bag 20, or inadvertent contact with the holder 10. Also in the preferred mode of the invention, each portion 90 has an upset surface 130 near each pivot point 120 to facilitate the setting of a preferred set position.

Preferably, the support base 30 also includes a clipping means 140 for attaching the frame 75 for compact storage and portability.

In operation, a frame 70 is inserted into the engagement means 60. The distal ends 100 of the arms 75 are adjusted so that the distance between the distal ends 100 is approximately equal to the inside dimension of the bag 20. The bag is then placed in an inverted orientation over the arms thereby being held in an open state to allow the bag to be sprayed with water for cleaning and then air drying. The support base 30 is relatively small, and therefore does not use much space on the flat support surface, typically a kitchen window sill or kitchen counter (not shown). When the bag 20 is dry, the bag is lifted off of the frame 70. The frame 70 may then be removed from the engagement means 60 and clipped into the clipping means 140 for storage or portability.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A holder for washing and drying at least one bag, comprising:

a support base having a bottom face for resting upon a flat support surface and a top face, the top face having engagement means therein; and at least one frame having two arms, each arm being segmented into two portions pivotally joined at their ends, the two portions thereby being able to be oriented at angles to each other, the ends of each of the arms being adapted for engagement in said engagement means, one portion of each arm being pivotally joined to the like portion of the other arm to allow the joined portions to move in scissor-like motion;

said end of one arm being engaged with said engagement means of the support base, the one arm thereby being positioned in a near vertical orientation, the other arm being positioned in an upward orientation and adjusted to form an angle between the two arms, the distal ends of the arms being adjusted so that the distance between the distal ends is approximately equal to the inside dimension of the bag, whereby the bag may be placed in an inverted orientation over the arms thereby being held in an open state to allow the bag to be sprayed with water for cleaning and then air dried.

2. The holder of claim 1 wherein each of the two portions has a roughened surface around the point of pivotal joining to permit the two portions to frictionally engage each other to allow the arms to maintain a set position against minor forces.

3. The holder of claim 1 wherein each of the two portions has an upset surface to permit the two portions to engage each other to facilitate the setting of a preferred set position.

4. The holder of claim 1 further including a means for clipping the arms to the base for compact storage.

5. A holder for washing and drying at least one bag, comprising:

a support base having a bottom face for resting upon a flat support surface and a top face, the top face having a plurality of engagement means therein; and a plurality of frames, each frame having two arms, each arm being segmented into two portions pivotally joined at their ends, the two portions thereby being able to be oriented at angles to each other, the ends of each of the arms being adapted for engagement in said engagement means, one portion of each arm being pivotally joined to the like portion of the other arm to allow the joined portions to move in scissor-like motion;

in each said frame of said plurality of frames, said end of one arm being engaged with one said engagement means of the support base, the one arm thereby being positioned in a near vertical orientation, the other arm being positioned in an upward orientation and adjusted to form an angle between the two arms, the distal ends of the arms being adjusted so that the distance between the distal ends is approximately equal to the inside dimension of one said bags, whereby one of said bags may be placed in an inverted orientation over the arms of each said frame thereby being held in an open state to allow the bags to be sprayed with water for cleaning and then air dried.

6. A holder for washing and drying at least one bag, comprising:

a support base having a bottom face for resting upon a flat support surface and a top face, the top face having engagement means therein; and at least one frame having two arms, each arm having a longer portion and a shorter portion, each of the longer portions being pivotally joined at the distal end to the proximal end of each of the shorter portions, the proximal end of each of the longer portions being adapted for engagement in said holding means, the longer portions of each arm being pivotally joined to allow the longer portions to move in scissor-like motion;

said proximal end of one longer portion being engaged with said engagement means of the support base, the one longer portion thereby being positioned in a near vertical orientation, the arms being positioned in an upward orientation and adjusted to form an angle between the two arms, the shorter portions of the arms being adjusted so that the distance between the distal ends of the shorter arms is approximately equal to the inside dimension of the bag, whereby the bag may be placed in an inverted orientation over the arms thereby being held in an open state to allow the bag to be sprayed with water for cleaning and then air dried.

* * * * *